US008096683B1

(12) United States Patent
Burrell, IV

(10) Patent No.: US 8,096,683 B1
(45) Date of Patent: Jan. 17, 2012

(54) REFLECTIVE LIGHT TUBE ASSEMBLY FOR LED LIGHTING

(76) Inventor: James W. Burrell, IV, Union, NJ (US)

( * ) Notice: Subject to any disclaimer, the term of this patent is extended or adjusted under 35 U.S.C. 154(b) by 0 days.

(21) Appl. No.: 13/228,962

(22) Filed: Sep. 9, 2011

(51) Int. Cl.
*F21S 4/00* (2006.01)
*F21V 21/00* (2006.01)

(52) U.S. Cl. ..... 362/249.02; 362/223; 362/311.02; 362/800

(58) Field of Classification Search ..... 362/217.01–217.17, 223, 225, 362/249.02, 311.02, 800
See application file for complete search history.

(56) References Cited

U.S. PATENT DOCUMENTS

| | | | | |
|---|---|---|---|---|
| 7,712,918 | B2 | 5/2010 | Siemiet et al. | |
| 7,926,975 | B2 | 4/2011 | Siemiet et al. | |
| 2011/0002682 | A1 * | 1/2011 | Messina | 396/200 |

* cited by examiner

*Primary Examiner* — Jason Moon Han

(74) *Attorney, Agent, or Firm* — Ezra Sutton, P.A.

(57) ABSTRACT

A reflective LED light tube assembly includes a bulb portion, a plurality of LEDs disposed inside the bulb portion on two longitudinal parallel facing heat dissipating reflective PCBs, both longitudinal PCB edges are longitudinally connected to a longitudinal reflective top portion and a longitudinal clear bottom portion, a pair of internally reflective end caps disposed at opposite ends of the bulb portion, a power supply circuit is disposed within one or both of the end caps or on the back of both PCBs, and a pair of male bi-pin electrical connectors extending from both end caps for electrical communication with the fluorescent light fixture's two tombstone female electrical connectors. One or both of the tombstone electrical connectors are in direct communication with an AC or DC power supply or circuit, which may also include a dimming feature. The LEDs illuminate in response to the electrical AC or DC current received in the power supply circuit.

19 Claims, 6 Drawing Sheets

100

110

200

200

200

300

400

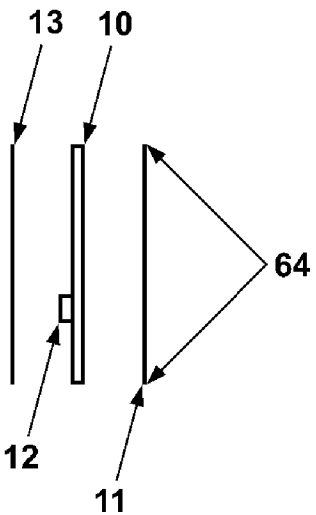
FIG. 27
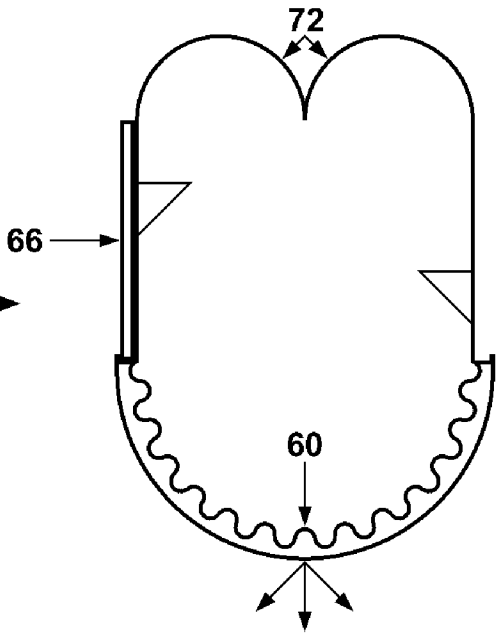
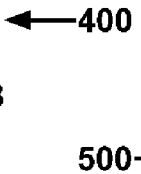
FIG. 26
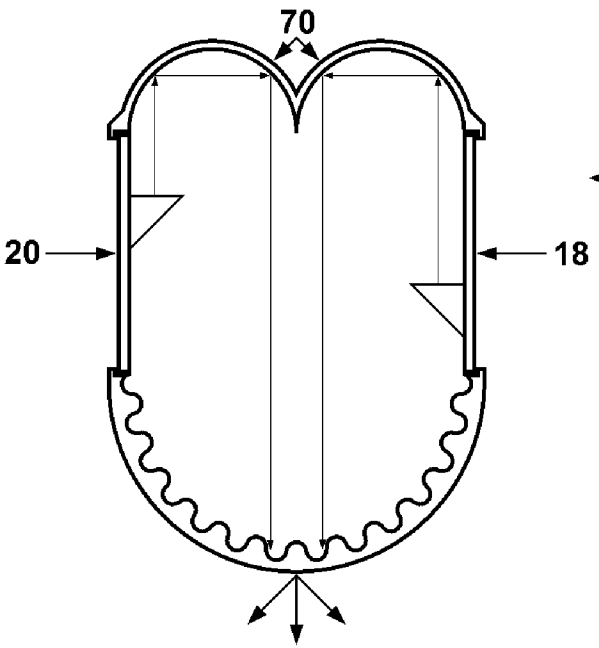

REFLECTIVE LIGHT TUBE ASSEMBLY FOR LED LIGHTING

FIELD OF THE INVENTION

The present invention relates to a reflective light emitting diode (LED) light tube assembly for reflectively dispersing the intense directional illumination of LEDs reflectively positioned inside the light tube assembly and for producing uniform linear light distribution, and more specifically, a reflective LED light tube assembly that can replace a fluorescent light bulb in a fluorescent light fixture, using solid-state electro-luminescence, powered by alternating current electricity and a preferred dimming feature.

DESCRIPTION OF THE PRIOR ART

Conventional fluorescent lighting systems include fluorescent light tubes and ballasts. Conventional fluorescent bulbs vaporize and ionize mercury gas (and argon, xenon, neon, or krypton gas at around 0.3% atmospheric pressure) using an electrical arc passing between two cathodes (preheat start-up, rapid start-up, or instant start-up electrodes) which produces ultraviolet rays that interact with the phosphor coating on the inside of the bulb, which glows or fluoresces and produces white light. The United States Environmental Protection Agency classifies fluorescent lamps as hazardous waste. Fluorescent lighting produces uniform non-directional light and has advantages over incandescent lighting, but fluorescent light bulbs and ballasts have a short life expectancy, fail when subjected vibrations, consume high amounts of power, require a high operating voltage, may cause interference with sensitive electronics (electromagnetic interference (EMI) or radio frequency interference (RFI)), do not perform well in extreme cold environments, produce a buzzing sound, and are prone to flickering. The fluorescent light bulb uses one quarter of electricity used by an incandescent light bulb and lasts 5 to 10 times longer than the incandescent light bulb. Solid-state electro-luminescence technology (LEDs) can last 100+ times longer than incandescent light bulbs if designed properly.

Every gas discharge lamp requires a unique ballast to operate at optimum performance. A ballast produces a high initial voltage to initiate the ionization and then limits the current to sustain efficient operation. Ballasts are either magnetic (transformer and capacitor), heater cutout/hybrid (electronic and magnetic components) or electronic (semi-resonant, quick, programmed, rapid, or instant start). A ballast is powered by 110 v-120 v AC at 60 Hz or 220-230 v AC at 50 Hz electricity. An electronic ballast converts the lamp operating frequency from 60 Hz or 50 Hz to 20-40 kHz to eliminate the flicker effect. Ballasts generate noise and carry sound level ratings A (best) through F (worst). Electronic ballasts rated A are almost inaudible.

Fluorescent light tubes are rated on their correlated color temperature (CCT). Warm-white is 2700K, neutral-white is 3000K-3500K, cool-white is 4100K, daylight is 5000K-6500K. The T5 tube's diameter of ⅝ inch, the T6 tube diameter is 21 mm, the T8 is 26 mm, the T9 is 31 mm, the T10 is 34 mm, and the T12 is 38-40.5 mm LED lighting is more efficient and LEDs last longer than fluorescent lights. LEDs have an advantage over fluorescent lighting technology because they do not have mercury (Hg), lead (Pb), or phosphor powder, don't require a ballast or starter, have a longer lifecycle, are more energy efficient, do not flicker, are capable of dimming, and operate in extreme cold. Fluorescent lighting fixtures retrofit with LEDs produce directional light output and are intensely bright when looked at. Fluorescent lighting assemblies retrofit with LEDs are usually covered with an opaque light transmissible casing which dims the appearance of the LEDs when looked at directly and reduces point source of glare.

Around 75% of our world is illuminated by fluorescent lighting and there is a desire to replace the mercury filled fluorescent light tube with the more efficient solid-state light emitting diode technology. Prior art LED fluorescent tube replacements usually include a multitude of linearly arranged LEDs facing downward along the length of a printed circuit board inside a translucent tube which produces the appearance of bright spots (point source of glare). There is a desire to provide a LED light tube and power supply circuit which has a long life expectancy, has a dimming feature, is resistant to vibration failure, consumes low amounts of power, produces a more natural light, functions in cold environments, is highly reliable, makes the retrofit cost affordable, creates a uniform light output, and is not irritating to the eyes while producing an antiglare feature. None of the prior art designs or solutions to improve the directional light output of fluorescent light tube retrofits using LED technology create an antiglare light output which is uniform and not irritating to the eyes. Some prior art U.S. LED technology patents have up to eight pages of prior art references. Dispersing LED light directly at objects results in harsh and uneven lighting and the appearance of bright spots from the high lumen output of the LED and the narrow viewing angle of the LEDs. The preferred embodiments of the reflective LED light tube assembly provide an even light source wherein the emitted light is not irritating to the eyes and the lumen output of the LEDs is not reduced from an opaque enclosure or lens.

Some of the preferred embodiments, using the reflective LED light tube assembly's end caps with electrode bi-pins, have the same physical dimensions, as required under international standards, for fluorescent tubes and fluorescent fixtures.

OBJECTS OF THE INVENTION

The main object of the present invention is to provide a fluorescent tube replacement using efficient light emitting diode (LED) technology using a reflective LED light tube assembly wherein the light produced is not irritating to the eyes when looked at directly or indirectly and where the light produced is uniform.

It is another object of the present invention to provide a fluorescent tube replacement using efficient light emitting diode (LED) technology using a reflective LED light tube assembly that does not reduce the lumen output of the light emitting diodes.

It is still another object of the present invention to provide a fluorescent tube replacement using efficient light emitting diode (LED) technology using a reflective LED light tube assembly wherein the power supply circuit of the reflective LED light tube assembly is powered by alternating current.

It is yet another object of the present invention to provide a fluorescent tube replacement using efficient light emitting diode (LED) technology using a reflective LED light tube assembly wherein the lumen output is adjustable.

It is a further object of the present invention to provide a fluorescent tube replacement using efficient light emitting diode (LED) technology using a reflective LED light tube assembly wherein the heat generated by the light emitting diodes is dissipated using a heat dissipating printing circuit board and thermoelectric cooling technology to reduce the operating temperature of the LEDs, increase the LEDs' functional lifetime, and to maintain the LEDs' high lumen output.

It is also an object of the present invention to provide a fluorescent tube replacement using efficient light emitting diode (LED) technology using a reflective LED light tube assembly wherein both parallel LED printed circuit boards are powered from only one end of the reflective LED light tube assembly (a slight cost reduction for manufacturing).

Finally, it is another object of the present invention to provide a fluorescent tube replacement using efficient light emitting diode (LED) technology using a reflective LED light tube assembly wherein the surface of the printed circuit board, where the LEDs are mounted, are covered with one or more photovoltaic panels for producing electricity.

These and other objects and advantages of the present invention are provided within this patent application.

SUMMARY OF THE INVENTION

The following summary is intended to highlight and introduce some aspects of the disclosed embodiments, but not to limit the scope of the claims. Thereafter, a detailed description of illustrative embodiments is presented which will permit one skilled in the relevant art to make and use various embodiments.

The present invention teaches a reflective light emitting diode (LED) light tube assembly to evenly distribute light along the length of the reflective LED light tube assembly and preventing direct eye contact with the LED light source. The LEDs are preferably mounted on heat dissipating circuit boards or substrate to increase the life and lumen output of the LEDs. The reflective LED light tube assembly is preferably powered by alternating current or can be powered by a direct current power supply circuit for powering the light emitting diodes disposed inside the tube portion, which includes a pair of end caps with bi-pin male electrical connectors disposed at opposite ends of the tube portion. The plurality of light emitting diodes are disposed inside the tube portion and are in electrical communication with the power supply circuit using at least one of the pair of bi-pin male electrical connectors on the end caps. The reflective LED light tube assembly includes two longitudinal parallel LED circuit boards where the spaced LEDs inwardly face the interior of the tube and the reflective surfaces of both circuit boards or the parallel reflective surfaces. Both circuit boards preferably dissipate the heat generated by the LEDs when they are powered. Both side LED circuit boards are connected longitudinally along the edges using a longitudinal reflective top portion (preferably half tubular or joined double half tubular) and a longitudinal transparent bottom portion (any type of lens) for letting all the generated light pass through. Basically, in any preferred embodiment, light is reflected into a light scattering reflective top portion and the light eventually exits the bottom lens end of the reflective LED light tube assembly.

The longitudinal clear bottom portion for letting the light pass through may be any type of cover, lens or prism, or any type of light scattering means which does not reduce the lumen output of the LEDs.

The power supply circuitry is disposed within one or both of the end caps, or can be located on the outside surfaces of both circuit boards, which can be cosmetically covered, but this will prevent heat dissipation.

A multitude of modifications and enhancements can be made to the preferred embodiments and elements of the present invention without departing from the spirit and scope of this invention as a whole. These and other objects, features and advantages of the present invention will be better understood in connection with the following drawings and descriptions of the preferred embodiments. Details of these embodiments, and others, are described in further detail hereinafter.

DESCRIPTION OF THE DRAWINGS

For a better understanding of the invention as well as other objects, features and advantages thereof, reference is made to the following detailed description to be read in conjunction with the accompanying drawings, wherein like reference numerals refer to like elements throughout the several views, and wherein.

Figure 8:
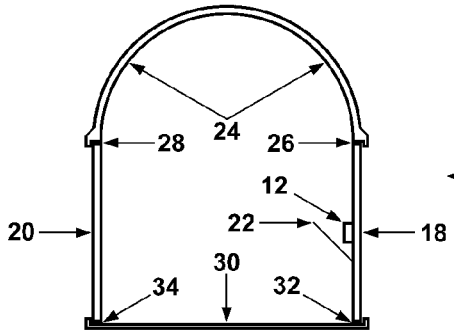
FIG. 8 shows a cross-sectional view of an assembled reflective LED light tube assembly 110 wherein the reflective heat dissipating LED PCBs 18 and 20 of FIGS. 2 and 3 face each other and use 45° LED directional light deflectors 22.
Figure 9:
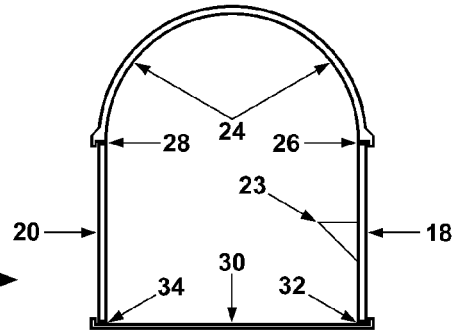
FIG. 9 shows a cross-sectional view of an assembled reflective LED light tube assembly 200 wherein the reflective heat dissipating LED PCBs 18 and 20 of FIGS. 4 and 5 face each other and use 45° LED sconce directional light deflectors 23.
Figure 10:
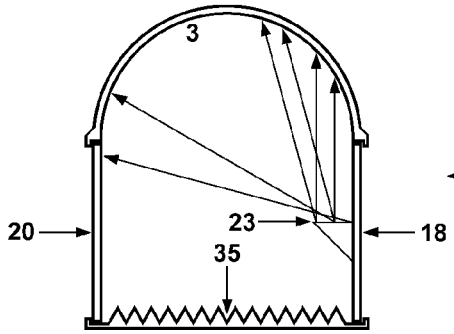
FIG. 10 shows a cross-sectional view of the light dispersal of a FIG. 9 assembled reflective LED light tube assembly 200 using a Fresnel lens 35 wherein the reflective heat dissipating LED PCBs 18 and 20 of FIGS. 4 and 5 face each other and use 45° LED sconce directional light deflectors 23.
Figure 15:
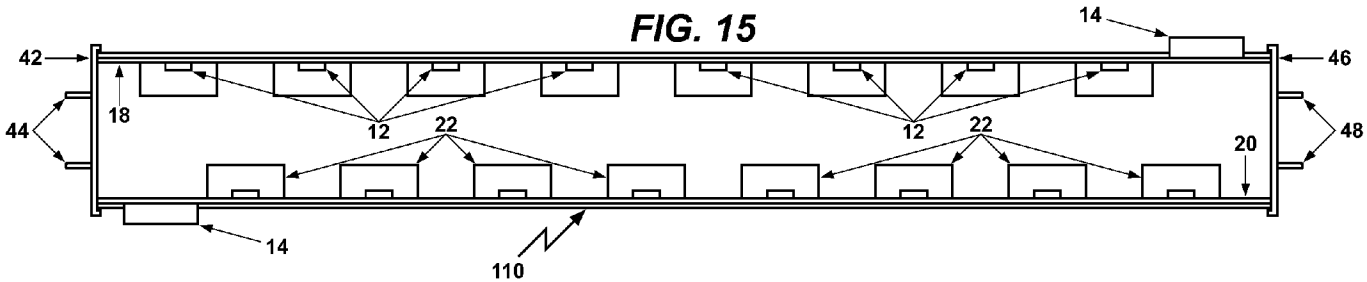
Figure 16:
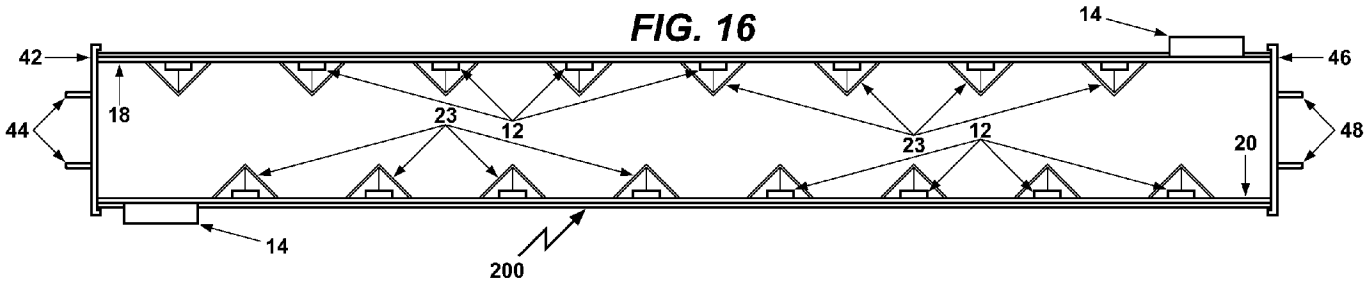
Figure 17:
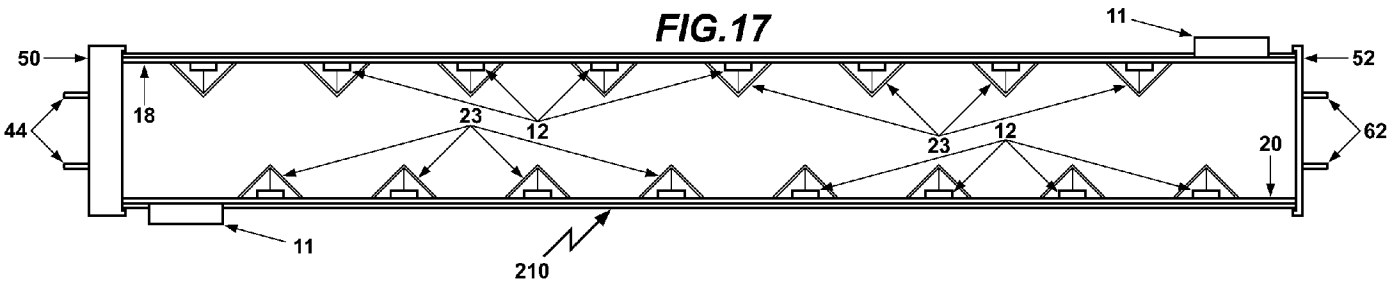
Figure 18:
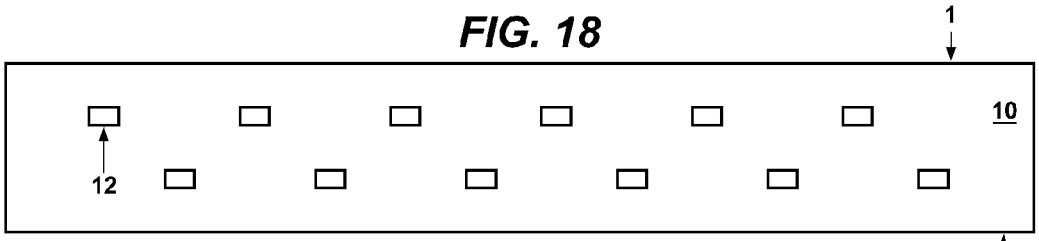
Figure 19:
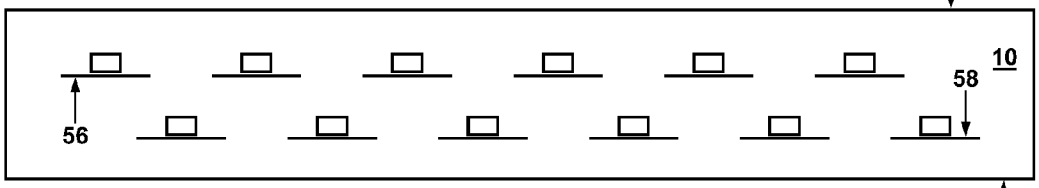
Figure 20:
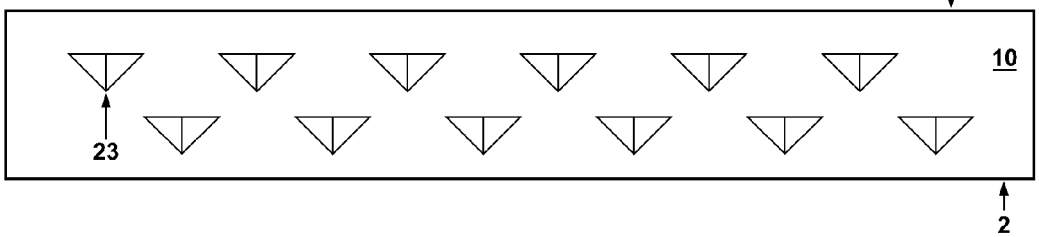
Figure 21:
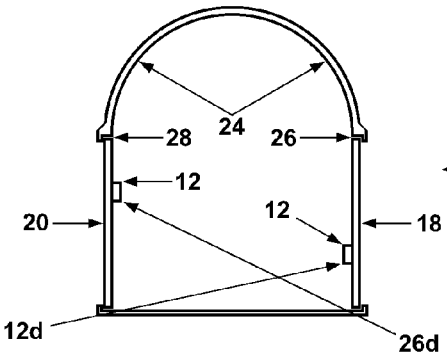
Figure 22:
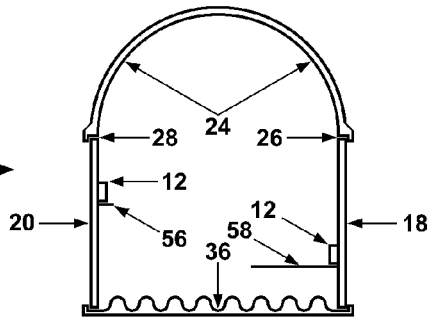
Figure 23:
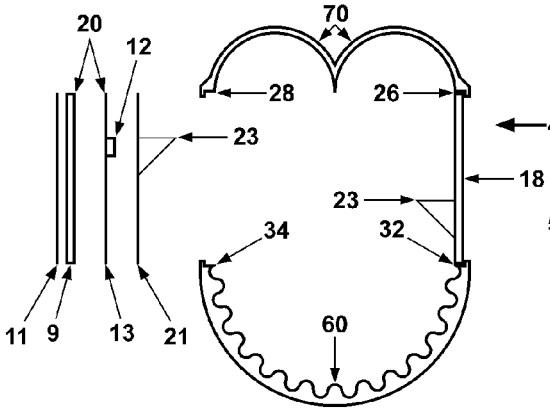
Figure 24:
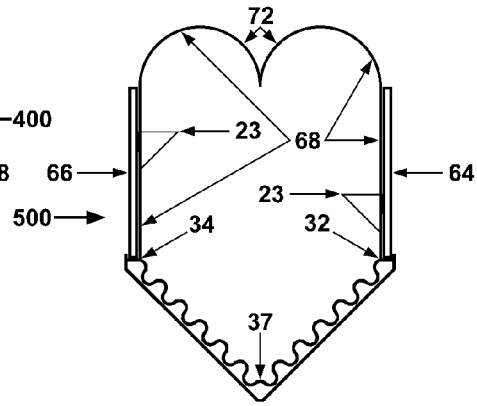
Figure 25:
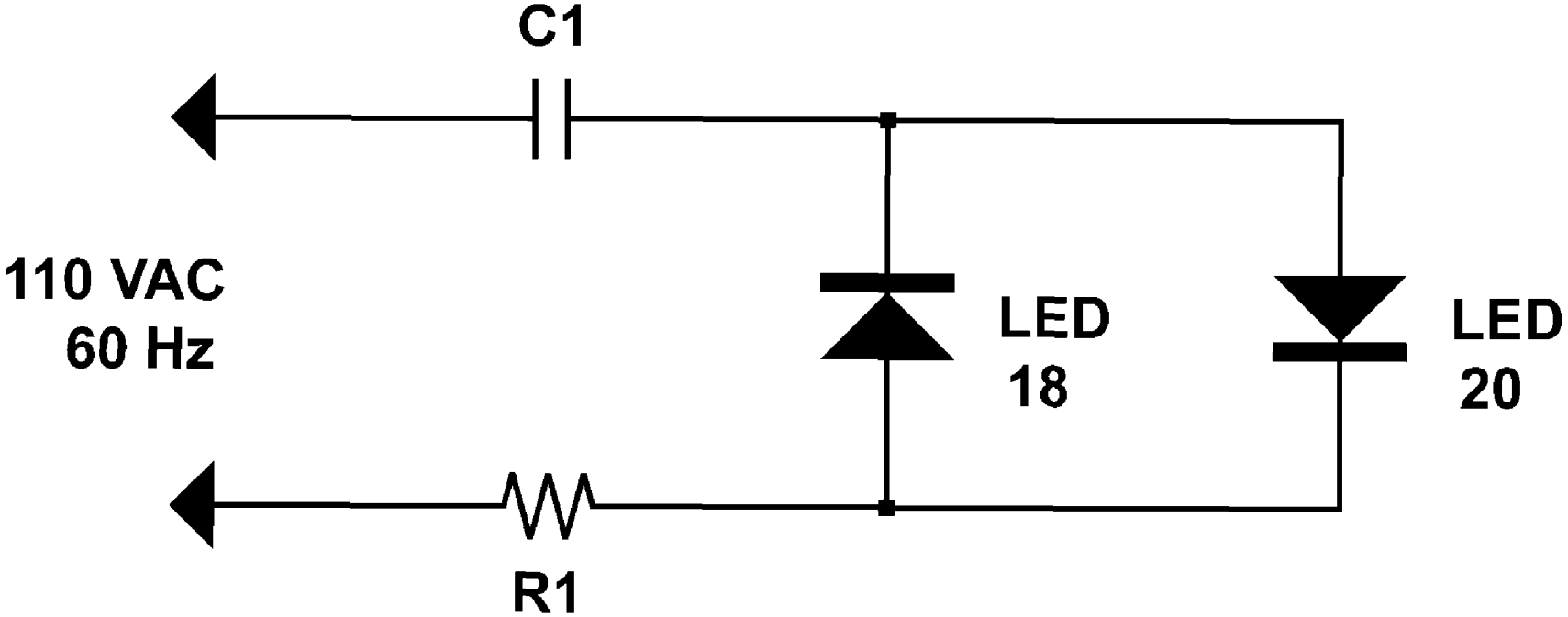

6 and 7, and the LED light is perpendicularly reflected onto the opposite reflective or photovoltaic covered PCB 10;

FIG. 15 shows a top view of a partially assembled reflective LED light tube assembly 110 shown in cross-sectional FIG. 8, and the LED light is reflected upward using a LED directional light deflector 22;

FIG. 16 shows a top view of a partially assembled reflective LED light tube assembly 200 shown in cross-sectional FIGS. 9 and 10, and the LED light is reflected upward using a LED 45° LED sconce directional light deflector 23;

FIG. 17 shows a top view of a partially assembled reflective LED light tube assembly 210 shown in cross-sectional FIGS. 9 and 10, and the LED light is reflected upward using 45° LED sconce directional light deflectors 23;

FIG. 18 shows a top view of two alternating rows of LEDs 12 mounted on a light reflective heat dissipating printed circuit board 10 shown in FIG. 21;

FIG. 19 shows a top view of two alternating rows of LEDs 12 mounted on a light reflective heat dissipating printed circuit board 10 with horizontal light deflectors 56 and 58 mounted beneath the LEDs 12 shown in FIG. 22;

FIG. 20 shows a top view of two alternating rows of LEDs 12 mounted on a light reflective heat dissipating printed circuit board 10 with sconce directional light deflectors 23 mounted over the LEDs 12 shown in FIGS. 23 and 24;

FIG. 21 shows a cross-sectional view of an assembled reflective LED light tube assembly 300 wherein two LED PCBs 18 and 20 of FIG. 18 face each other and the viewing angle 26*d* of the top row of LEDs 12 and the viewing angle 12*d* of the bottom row of LEDs 12 is shown;

FIG. 22 shows a cross-sectional view of an assembled reflective LED light tube assembly 300 wherein two LED PCBs 18 and 20 of FIG. 19 face each other and where a top row of LEDs 12 has bottom mounted horizontal light deflectors 56 and a bottom row of LEDs 12 has bottom mounted horizontal light deflectors 58;

FIG. 23 shows a cross-sectional view of an assembled reflective LED light tube assembly 400 wherein two LED PCBs 18 and 20 of FIG. 20 face each other and LED directional light deflectors 23 direct the light into the reflective double half cylindrical light scattering longitudinal top cap 70;

FIG. 24 shows a cross-sectional view of an assembled reflective LED light tube assembly 500 wherein two LED PCBs 64 and 66 face each other and LED directional light deflectors 23 direct the light into the reflective double half cylindrical light scattering portion 72 of the interiorly reflective longitudinally m-shaped parallel side walled light scattering chassis 68;

FIG. 25 shows a schematic for an electrical circuit to power two LED PCBs 18 and 20 using AC power;

FIG. 26 shows a cross-sectional view of the perpendicular light dispersal of a FIG. 23 assembled reflective LED light tube assembly 400 wherein two LED PCBs 18 and 20 of FIG. 20 face each other and LED directional light deflectors 23 direct the light into the reflective double half cylindrical light scattering longitudinal top cap 70; and FIG. 27 shows a cross-sectional view of a FIG. 24 assembled reflective LED light tube assembly 500 wherein two LED PCBs 64 and 66 face each other and LED directional light deflectors 23 direct the light into the reflective double half cylindrical light scattering portion 72 of the interiorly reflective longitudinally m-shaped parallel side walled light scattering chassis 68, and the PCB layers.

The light rays illustrated in the figures are for illustrative purposes only and are not intended to accurately portray the actual dispersion of light from the LEDs. The terms top, bottom, and side used to describe the present invention will change based on the orientation of the reflective LED light tube assembly.

LIST OF REFERENCE NUMBERING

In the drawings, the following reference numerals have the following general descriptions:

1 shows a top longitudinal edge of a heat dissipating printed circuit board;
2 shows a bottom longitudinal edge of a heat dissipating printed circuit board;
3 shows a preferred focal point for light to be reflected off of the reflective half cylindrical light scattering longitudinal top cap;
9 shows a heat dissipating layer;
10 shows a printed circuit board with heat dissipating properties;
11 shows a thermoelectric cooling element or layer;
12 shows a light emitting diode (LED);
12*d* shows a 12° angle where a bottom row LED bright spot would be seen without a reflector;
13 shows a dielectric layer;
14 shows a power supply circuit;
16 shows an prior art LED circuit board with heat dissipating properties;
18 shows an first side reflective LED light tube heat dissipating PCB;
20 shows an second side reflective LED light tube heat dissipating PCB;
21 shows an interior light deflecting layer;
22 shows a LED directional light deflector;
23 shows a LED sconce directional light deflector;
24 shows a reflective half cylindrical light scattering longitudinal top cap;
26 shows a first longitudinally joining top edge;
26*d* shows a 26° angle where a top row LED bright spot would be seen without a reflector;
28 shows a second longitudinally joining top edge;
30 shows a longitudinal light transmissible planar lens cap;
32 shows a first longitudinally joining bottom edge;
34 shows a second longitudinally joining bottom edge;
35 shows a longitudinal light transmissible Fresnel planar lens cap with 14 prism lenses;
36 shows a longitudinal light transmissible Fresnel planar lens cap with 8 curved lenses;
37 shows a longitudinal light transmissible V-shaped Fresnel planar lens cap with 13 curved lenses;
38 shows a longitudinal light transmissible solid lens cap;
40 shows a longitudinal light transmissible half cylindrical lens cap;
42 shows a first end cap with a reflective interior and a set of two electrical bi-pins;
44 shows a first set of two electrical bi-pins;
46 shows a second end cap with a reflective interior and a set of two electrical bi-pins;
48 shows a second set of two electrical bi-pins;
50 shows a first reflective internal power supply circuit end cap with two electrical bi-pins;
52 shows a second end cap with a reflective interior with two unused "dummy" electrical bi-pins;
54 shows a thermoelectric cooling means;
56 shows a bottom mounted horizontal light deflector for a top row of LEDs;
58 shows a bottom mounted horizontal light deflector for a bottom row of LEDs;

60 shows a longitudinal light transmissible half cylindrical Fresnel lens cap;

62 shows a second set of two unelectrified "dummy" electrical bi-pins;

64 shows an assembled first side LED light tube heat dissipating PCB;

66 shows an assembled second side LED light tube heat dissipating PCB;

68 shows a longitudinally parallel walled double half cylindrical reflective light scattering chassis;

70 shows a reflective double half cylindrical light scattering longitudinal top cap;

72 shows a interiorly reflective longitudinally m-shaped light scattering portion;

100 shows a first reflective light emitting diode (LED) light tube assembly;

110 shows a second reflective light emitting diode (LED) light tube assembly;

200 shows a third reflective light emitting diode (LED) light tube assembly;

210 shows a preferred forth reflective light emitting diode (LED) light tube assembly powered from only one end;

300 shows a fifth reflective light emitting diode (LED) light tube assembly;

400 shows a preferred sixth reflective light emitting diode (LED) light tube assembly; and

500 shows a preferred seventh reflective light emitting diode (LED) light tube assembly.

DETAILED DESCRIPTION OF THE PREFERRED EMBODIMENTS

While this invention is susceptible of embodiments in many different forms, there are shown in the drawings and will herein be described in detail the preferred embodiments of the present invention with the understanding that the present disclosure is to be considered as an exemplification of the principles of the invention and is not intended to limit the broad aspects of the invention to the embodiments illustrated. According to the present invention, the foregoing and other objects and advantages are attained by providing a more efficient reflective light emitting diode (LED) light tube assembly with none of the known prior art LED technology lighting disadvantages.

Fluorescent light fixtures retrofit with prior art LED tubes distribute light directly toward objects to be illuminated. Embodiments of non-linear light distribution using a reflective LED light tube assembly, that provides even light distribution, are disclosed herein. By placing LEDs in certain orientations and reflecting the light off the half cylindrical or the joined double half cylindrical light reflecting top portion, where the reflected light is preferably emitted through some type of Fresnel lens, the appearance of bright spots is overcome, and dispersed even lighting is provided. Embodiments of an even light distribution means, using the reflective LED light tube assembly, are illustrated in FIGS. 1-27.

In the following description of the preferred embodiments:

reflective LED light tube assemblies shall not be limited to the shape of tubular, conical, cylinders, rings, circles, triangles, rectangles, hexagons, octagons, polygonals, toroidal, linear, curvilinear, U-shaped, or any shape required by the specific application to produce the preferred embodiment (one embodiment is a reflective LED light tube assembly including a body configured to fit within a pre-existing fluorescent light fixture);

printed circuit boards and heat dissipating printed circuit boards 10 shall not be limited to aluminum, ceramic, copper, thermoelectric heat pumps, thermoelectric coolers, thermally conductive plastic, heat dissipating plastic, or any type of other thermally conductive or heat dissipating printed circuit board (high brightness LEDs need more heat dissipation and require the use of a metal substrate PCB having a circuit layer, dielectric layer, and a metal base layer or a ceramic substrate PCB);

reflective surfaces shall not be limited to a polished metal surfaces, Mylar™ coatings, holographic coatings, ultra-white surfaces, solar cells, or any other type of reflective surface;

LEDs 12 or light generation shall not be limited to rectangular, square or round LEDs, ultra bright white LEDs, high power LEDs (HPLED), colored light emitting diodes (white, infrared, red, orange, yellow, amber, green, blue, violet, purple, ultraviolet), Dip LEDs, SMD LEDs, common 8 mm, 5 mm and 3 mm acrylic lens LEDs, wide angle (Lambertian) LEDs, bi-color LEDs, tri-color LEDs, RGB LEDs, quad-color LEDs, organic light emitting diodes (OLEDs), polymer light-emitting diodes (PLED), quantum dot LEDs, incandescent, halogen, HID, MH, MSR, HPS, phosphorescent, laser, electro-luminescent, or any other type of low voltage light emitting device (combining ultra bright white LEDs with combinations of infrared, red, orange, yellow, amber, green, blue, violet, purple, ultraviolet, etc. LEDs, allows the present invention to produce a varied light output, closer to natural sunlight, which may also have added health benefits, including red and blue LEDs increases photosynthesis in plants);

the LEDs electrical connecting means shall not be limited to a parallel or a series configuration (using a series configuration is not preferred because if one of the LEDs fails the entire array of LEDs will longer work);

lenses shall not be limited to flat, convex, concave, biconvex, plano-convex, convexo-concave, concavo-concave, plano-concave, concavo-convex, Fresnel lenses, Fresnel lenses having multiple prism facets, Fresnel lenses having multiple curved facets, light diffusing geometries including ridges, bumps, dimples, dots, or any other type of uneven surface light diffusion filter, any light diffusing means including diffusing films, or any type of lens for concentrating or disbursing light by refraction, diffusion, converging or diverging;

lens composition shall not be limited to polycarbonate, Plexiglass®, Lexan®, acrylic, glass, epoxy, polyurethane, polymethylmethacrylate, silicone, fluorocarbon polymers, polyethermide, or any transparent, opaque, frosted, or translucent light transmissible material which allows a preferred unrestricted flow of light;

the light reflected from the reflecting surfaces may be reflected off of the reflective surfaces one or more times before exiting the reflective LED light tube assembly's light transmissible longitudinal lens cap;

powering means shall not be limited to being powered by the fluorescent light fixtures AC power source and magnetic, hybrid, or electronic fluorescent ballast, the AC power source and a rectifier/filter circuit, a DC power source and pulse width modulation circuit, a inductive power supply circuit, directly powered by the alternating current power source or using a multi-volt driver, or powered by any powering means known in the art (a prior art method of using DC power to power the present invention also includes DC power from a rectifier/filter circuit running through a pulse width modulation circuit which cyclically turns the DC power source on and off);

electrical communication means shall not be limited to electrical male bi-pin connectors 44 and 48 (type G13) for insertion into a conventional fluorescent light tube socket (not shown), also known as a tombstone socket, single pin connectors, recessed DC connectors, recessed double contact connectors, but shall include any electrical male connection means with a corresponding electrical female connector; and light dimming means to adjust the light intensity from 0% to 100% brightness shall not be limited to triac type dimmers, duty cycle modulated dimmers, amplitude modulated dimmers, frequency modulated dimmers, direct current voltage dimmers, current drivers, voltage drivers, autotransformers, rheostats, power op-amps, linear amplifiers, transistors, switches, variable resistors, or any other type of light dimming means (The LED lighting on/off feature or intensity may also be adjusted by means of a timers, motion detectors, light level sensors or photosensors to detect ambient light in a room or outside and adjust the LED lighting intensity accordingly).

The interior reflective surfaces inside the reflective LED light tube assembly are preferably made out of a reflective material, such as a mirror made of glass or plastic with a metallic coating on its backside or inside surfaces, or a highly polished metal chassis. Both PCB interior surfaces and the reflective half cylindrical or joined double half cylindrical light scattering cap should have as close to 100% internal reflection as possible in order to maximize the lumen output of the reflective LED light tube assembly. Light rays can ricochet off of the reflective PCB interior surfaces and the reflective half cylindrical or joined double half cylindrical light scattering cap multiple times before exiting the reflective LED light tube assembly's lens end. The specific curvature and height of the reflective half cylindrical or joined double half cylindrical light scattering cap is dependent on the viewing angle of each LED and the distance from each LED to the reflective half cylindrical or joined double half cylindrical light scattering cap. The reflective half cylindrical or joined double half cylindrical light scattering cap may also have multiple horizontal or vertical triangular reflectors, multiple horizontal or vertical curved reflectors, light diffusing geometries including ridges, bumps, dimples, dots, or any other type of even or uneven light diffusing surface, any light diffusing means including diffusing films, or any type of means for concentrating or disbursing light by refraction, diffusion, converging or diverging. A LED with a narrow viewing angle requires a greater angle of deflection and focal length than a LED with a wide viewing angle in order to achieve the same distribution of light exiting the reflective LED light tube assembly. A LED with a narrow viewing angle may also be reflected off the reflective half cylindrical or joined double half cylindrical light scattering cap coated with a pure white interior surface to reduce bright-spots.

Figure 1:
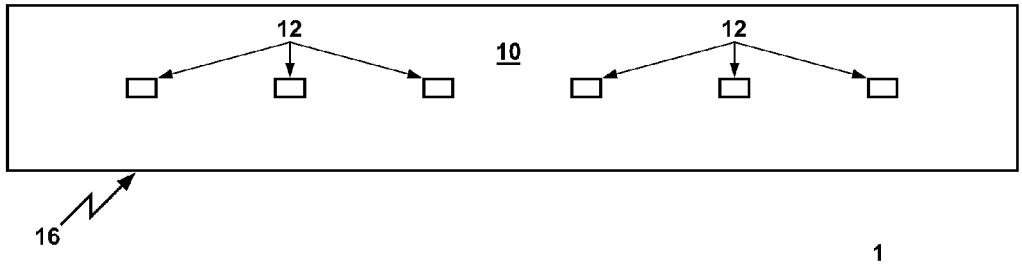
FIG. 1 shows a prior art top view of a single row of LEDs 12 mounted on heat dissipating printed circuit board 10 (PCB) 16.

FIG. 1 shows a prior art top view of a single row of LEDs 12 mounted on heat dissipating printed circuit board 16 (PCB) 10. The prior art use of this configuration causes bright spots when looked at.

Figure 2:
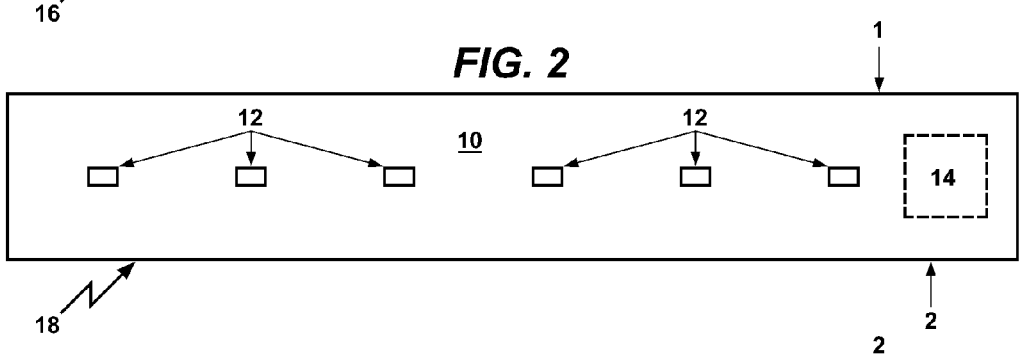
FIG. 2 shows a top view of a row of LEDs 12 mounted on a first light reflective heat dissipating printed circuit board 18.

FIG. 2 shows a top view of a row of LEDs 12 mounted on a first light reflective heat dissipating printed circuit board 18 with a power supply circuit 14 located on the back of the PCB 10. 1 shows a top longitudinal edge of a heat dissipating printed circuit board and 2 shows a bottom longitudinal edge of a heat dissipating printed circuit board.

Figure 3:
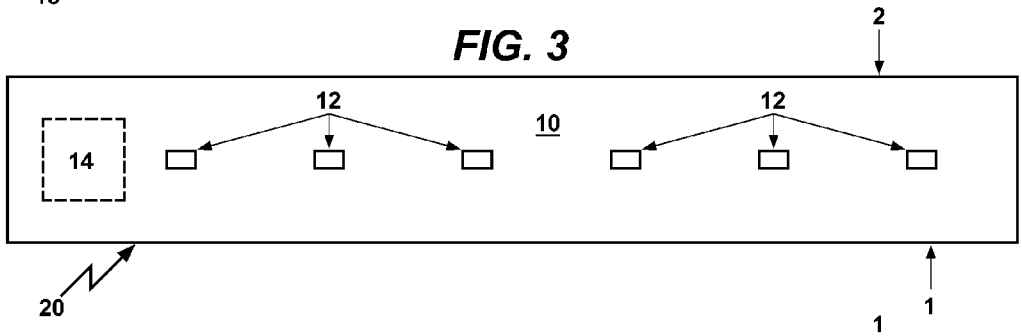
FIG. 3 shows a top view of a row of LEDs 12 mounted on a second light reflective heat dissipating printed circuit board 20.

FIG. 3 shows a top view of a row of LEDs 12 mounted on a second light reflective heat dissipating printed circuit board 20 with a power supply circuit 14 located on the back of the PCB 10. 1 shows a top longitudinal edge of a heat dissipating printed circuit board and 2 shows a bottom longitudinal edge of a heat dissipating printed circuit board.

Figure 4:
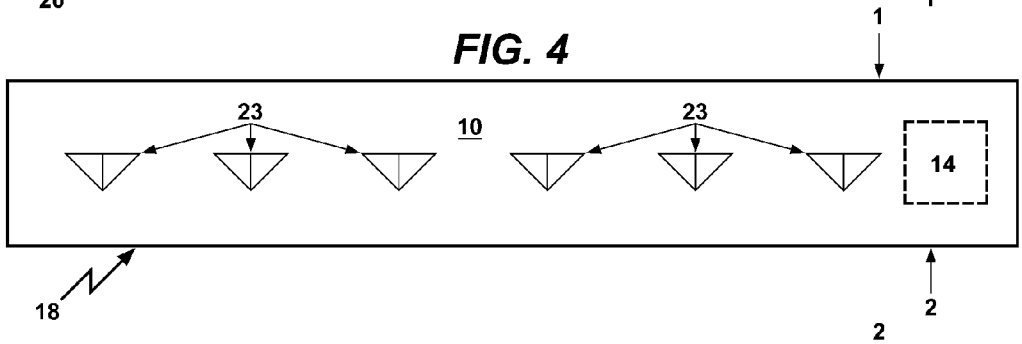
FIG. 4 shows a top view of a row of LEDs 12 mounted on a first light reflective heat dissipating printed circuit board 18 wherein the LEDs 12 are covered by LED directional sconce light deflectors 23.

FIG. 4 shows a top view of a row of LEDs 12 mounted on a first light reflective heat dissipating printed circuit board 18 wherein the LEDs 12 are covered by LED directional sconce light deflectors 23 with a power supply circuit 14 located on the back of the PCB 10. 1 shows a top longitudinal edge of a heat dissipating printed circuit board and 2 shows a bottom longitudinal edge of a heat dissipating printed circuit board.

Figure 5:
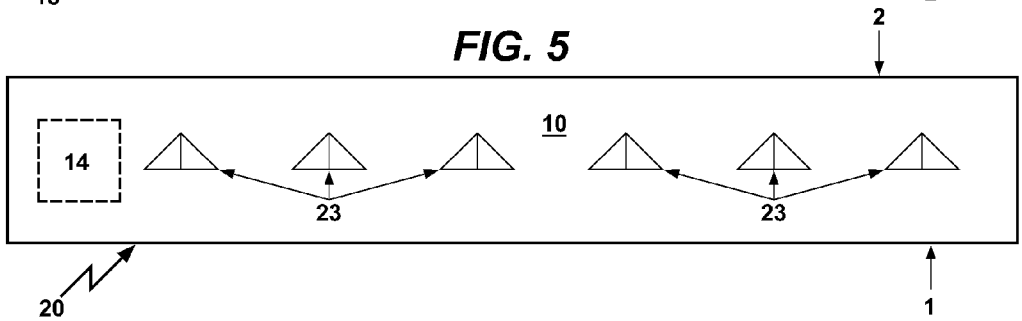
FIG. 5 shows a top view of a row of LEDs 12 mounted on a second light reflective heat dissipating printed circuit board 20 wherein the LEDs 12 are covered by LED directional sconce light deflectors 23.

FIG. 5 shows a top view of a row of LEDs 12 mounted on a second light reflective heat dissipating printed circuit board 20 wherein the LEDs 12 are covered by LED directional sconce light deflectors 23 with a power supply circuit 14 located on the back of the PCB 10.1 shows a top longitudinal edge of a heat dissipating printed circuit board and 2 shows a bottom longitudinal edge of a heat dissipating printed circuit board.

In FIGS. 6-13, the reflective LED light tube assembly's first LED PCB's 18 top edge 1 is joined to connection location 26 on the bottom edge of the reflective half cylindrical light scattering longitudinal top cap 24, the second LED PCB's 20 top edge 1 is joined to connection location 28 on the bottom edge of the reflective half cylindrical light scattering longitudinal top cap 24, the first LED PCB's 18 bottom edge 2 is joined to connection location 26 on the top edge of the longitudinal light transmissible bottom lens cap 30, 36, 38, 40, or 60, and the second LED PCB's 20 bottom edge 2 is joined to connection location 28 on the top edge of the longitudinal light transmissible bottom lens cap 30, 36, 38, 40, or 60, wherein all joined connections use either a gluing means, an ultrasonic welding means, snap-fit means, male and female insertion means, or any other suitable attaching means known to those having any skill in the art. The reflective heat dissipating LED PCBs 18 and 20 reflective surfaces may also comprise photovoltaic cells.

Figure 6:
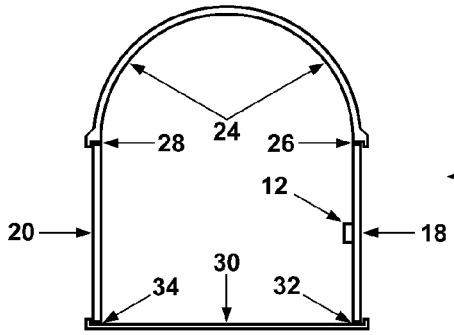
FIG. 6 shows a cross-sectional view of an assembled reflective LED light tube assembly 100 wherein the reflective heat dissipating LED PCBs 18 and 20 of FIGS. 2 and 3 face each other.

FIG. 6 shows a cross-sectional view of the assembled reflective LED light tube assembly 100 wherein the reflective heat dissipating LED PCBs 18 and 20 of FIGS. 2 and 3 face each other and are longitudinally connected to a reflective half cylindrical light scattering longitudinal top cap 24 and a longitudinal light transmissible planar lens cap 30.

Figure 7:
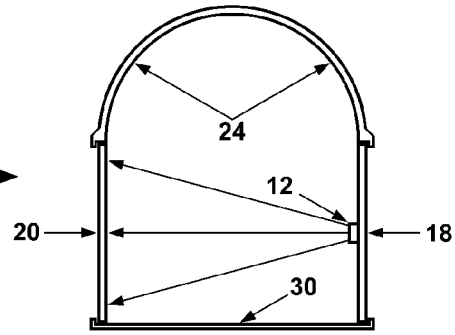
FIG. 7 shows a cross-sectional view of an assembled reflective LED light tube assembly 100 and the LED's light dispersal wherein the reflective heat dissipating LED PCBs 18 and 20 of FIGS. 2 and 3 face each other.

FIG. 7 shows a cross-sectional view of the assembled reflective LED light tube assembly 100 and the LED's light dispersal wherein the reflective heat dissipating LED PCBs 18 and 20 of FIGS. 2 and 3 face each other and are longitudinally connected to a reflective half cylindrical light scattering longitudinal top cap 24 and a longitudinal light transmissible planar lens cap 30.

At the time of the present invention, the commercially available LED's light dispersal angle is up to 120° in high brightness LEDs and cheaper LEDs can have a light dispersal of around 6°. The greater the angle of light dispersion of the LEDs used in the reflective LED light tube assembly, the more efficient the reflective LED light tube assembly produces uniform light.

Using an ultra bright LED with a light dispersion angle of 120°, in the FIGS. 6 and 7 embodiment, combined with a longitudinal light transmissible half cylindrical Fresnel lens cap 60 would produce a reflective LED light tube assembly that would reduce the appearance of bright spots. Placing photovoltaic cells on the reflective LED light tube assembly's PCBs (not shown) would produce a direct current power source for powering the reflective LED light tube assembly, or for storing the generated electricity using some type of storage means, or for feeding the produced electricity back onto the electrical grid.

FIG. 8 shows a cross-sectional view of the assembled reflective LED light tube assembly 110 wherein the reflective heat dissipating LED PCBs 18 and 20 of FIGS. 2 and 3 face each other and are longitudinally connected to a reflective half cylindrical light scattering longitudinal top cap 24 and a longitudinal light transmissible planar lens cap 30, and the LED light is reflected upward into the reflective half cylindrical light scattering longitudinal top cap 24 using 45° LED directional light deflectors 22 attached to the bottom of each LED 12. This method of redirecting light into the reflective half cylindrical light scattering longitudinal top cap 24 would still allow the appearance of bright spots longitudinally.

FIG. 9 shows a cross-sectional view of the assembled reflective LED light tube assembly 200 wherein the reflective heat dissipating LED PCBs 18 and 20 of FIGS. 4 and 5 face each other and are longitudinally connected to a reflective half cylindrical light scattering longitudinal top cap 24 and a longitudinal light transmissible planar lens cap 30, and the LED light is reflected upward into the reflective half cylindrical light scattering longitudinal top cap 24 using 45° LED sconce directional light deflectors 23. This method of redirecting light into the reflective half cylindrical light scattering longitudinal top cap 24 prevents the appearance of bright spots longitudinally.

FIG. 10 shows a cross-sectional view of the light dispersion of the FIG. 9 assembled reflective LED light tube assembly 200 embodiment wherein the reflective heat dissipating LED PCBs 18 and 20 of FIGS. 4 and 5 face each other and are longitudinally connected to a reflective half cylindrical light scattering longitudinal top cap 24 and a longitudinal light transmissible Fresnel planar lens cap 36, and the LED light is reflected upward into the reflective half cylindrical light scattering longitudinal top cap 24 using 45° LED sconce directional light deflectors 23 and a bright spot focal point 3. The 45° LED sconce directional light deflectors 23 reflect perpendicular light at a 90° angle into the reflective half cylindrical light scattering longitudinal top cap 24 where it is reflected into the bright spot focal point 3 and then reflected through the longitudinal light transmissible Fresnel planar lens cap 36 The longitudinal light transmissible Fresnel planar lens cap 35 is shown with fourteen prism lenses. The 45° LED sconce directional light deflectors 23 angle can be modified to reflect perpendicular light at an angle greater than the 90° shown.

Figure 11:
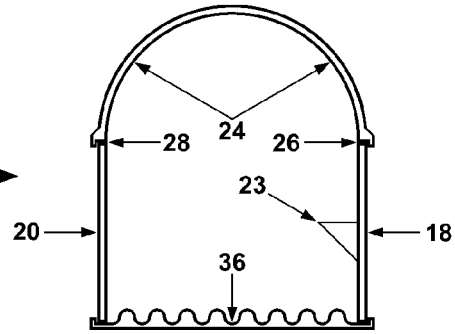
FIG. 11 shows a cross-sectional view of an assembled reflective LED light tube assembly 200 using a Fresnel lens 36 wherein the reflective heat dissipating LED PCBs 18 and 20 of FIGS. 4 and 5 face each other and use 45° LED sconce directional light deflectors 23.

FIG. 11 shows a cross-sectional view of the assembled reflective LED light tube assembly 200 wherein the reflective heat dissipating LED PCBs 18 and 20 of FIGS. 4 and 5 face each other and are longitudinally connected to a reflective half cylindrical light scattering longitudinal top cap 24 and a longitudinal light transmissible Fresnel planar lens cap 36, and the LED light is reflected upward into the reflective half cylindrical light scattering longitudinal top cap 24 using a 45° LED sconce directional light deflector 23. The longitudinal light transmissible Fresnel planar lens cap 36 is shown with eight curved lenses. It would be obvious to one skilled in the art to increase or decrease the amount of curved lenses based on the application where the reflective LED light tube assembly is used.

Figure 12:
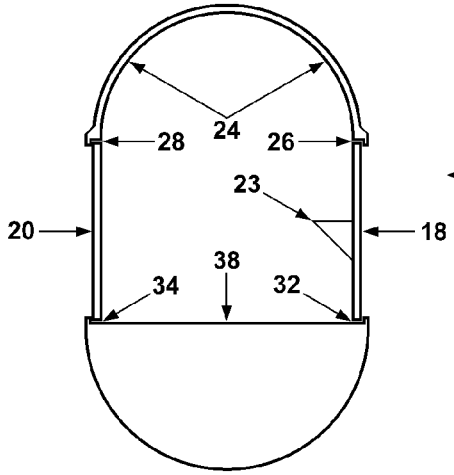
FIG. 12 shows a cross-sectional view of an assembled reflective LED light tube assembly 200 using a solid lens 38 wherein the reflective heat dissipating LED PCBs 18 and 20 of FIGS. 4 and 5 face each other and use 45° LED sconce directional light deflectors 23.

FIG. 12 shows a cross-sectional view of the assembled reflective LED light tube assembly 200 wherein the reflective heat dissipating LED PCBs 18 and 20 of FIGS. 4 and 5 face each other and are longitudinally connected to a reflective half cylindrical light scattering longitudinal top cap 24 and a longitudinal light transmissible bottom solid plano-convex lens cap 38, and the LED light is reflected upward into the reflective half cylindrical light scattering longitudinal top cap 24 using a 45° LED sconce directional light deflector 23. Using a longitudinal light transmissible bottom solid plano-convex lens cap 38 would be obvious to one skilled in the art, but the amount of material to produce this type of lens would be costly and would greatly increase the weight and cost of this reflective LED light tube assembly embodiment.

Figure 13:
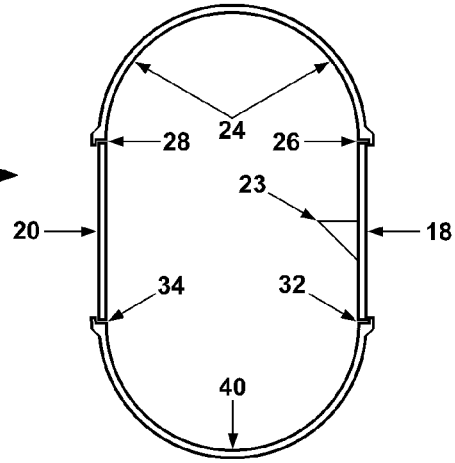
FIG. 13 shows a cross-sectional view of an assembled reflective LED light tube assembly 200 using a half cylindrical curved lens 40 wherein the reflective heat dissipating LED PCBs 18 and 20 of FIGS. 4 and 5 face each other and use 45° LED sconce directional light deflectors 23.

FIG. 13 shows a cross-sectional view of the assembled reflective LED light tube assembly 200 wherein the reflective heat dissipating LED PCBs 18 and 20 of FIGS. 4 and 5 face each other and are longitudinally connected to a reflective half cylindrical light scattering longitudinal top cap 24 and a longitudinal light transmissible half cylindrical lens cap 40, and the LED light is reflected upward into the reflective half cylindrical light scattering longitudinal top cap 24 using 45° LED sconce directional light deflectors 23. Using an ultra bright LED with a light dispersion angle of 120° with a longitudinal light transmissible half cylindrical lens cap 40 would be the cheapest embodiment for industrial applications, but the longitudinal light transmissible half cylindrical Fresnel lens cap 60 will always be the preferred embodiment.

In FIGS. 14-17, all of the LEDs 12 face inward from the reflective heat dissipating printed circuit board mounting surface. The LEDs are positioned and flushly mounted to emit their light perpendicularly to the heat dissipating printed circuit board 10. In one preferred embodiment of the present invention, all of the LEDs 12 emit only white light, and are referred to in the art as white LEDs.

Figure 14:
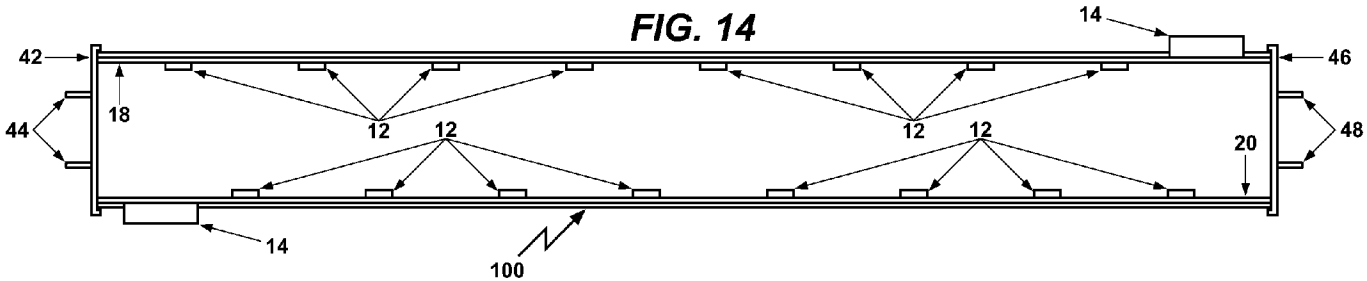
FIG. 14 shows a top view of a partially assembled reflective LED light tube assembly 100 shown in cross-sectional FIGS.

FIG. 14 shows a top view of the assembled reflective LED light tube assembly 100 shown in cross-sectional FIGS. 6 and 7, without the reflective half cylindrical light scattering longitudinal top cap 24, wherein the reflective heat dissipating LED PCBs 18 and 20 of FIGS. 2-3 face each other and are longitudinally connected to a reflective half cylindrical light scattering longitudinal top cap 24 (not shown) with both reflective interior end caps 42 and 46 attached and the LED light is perpendicularly reflected onto the opposite reflective or solar cell covered PCB 10. A first LED PCB's 18 power supply circuit 14 is in electrical communication with a first set of two electrical bi-pins 44 and said first end cap with a reflective interior 42, and a second LED PCB's 20 power supply circuit 14 is in electrical communication with a second set of two electrical bi-pins 48 and said second end cap with a reflective interior 46.

FIG. 15 shows a top view of the assembled reflective LED light tube assembly 110 shown in cross-sectional FIG. 8, without the reflective half cylindrical light scattering longitudinal top cap 24, wherein the reflective heat dissipating LED PCBs 18 and 20 face each other and are longitudinally connected to a reflective half cylindrical light scattering longitudinal top cap 24 (not shown) with both reflective interior end caps 42 and 46 attached and the LED light is reflected upward using 45° LED directional light deflectors 22. A first LED PCB's 18 power supply circuit 14 is in electrical communication with a first set of two electrical bi-pins 44 and said first end cap with a reflective interior 42, and a second LED PCB's 20 power supply circuit 14 is in electrical communication with a second set of two electrical bi-pins 48 and said second end cap with a reflective interior 46.

FIG. 16 shows a top view of the assembled reflective LED light tube assembly 200 shown in cross-sectional FIGS. 9 and 10, without the reflective half cylindrical light scattering longitudinal top cap 24, wherein the reflective heat dissipating LED PCBs 18 and 20 of FIGS. 4 and 5 face each other and are longitudinally connected to a reflective half cylindrical light scattering longitudinal top cap 24 (not shown) with both reflective interior end caps 42 and 46 attached and the LED light is reflected upward using 45° LED sconce directional light deflectors 23. A first LED PCB's 18 power supply circuit 14 is in electrical communication with a first set of two electrical bi-pins 44 and said first end cap with a reflective interior 42, and a second LED PCB's 20 power supply circuit 14 is in electrical communication with a second set of two electrical bi-pins 48 and said second end cap with a reflective interior 46.

FIG. 17 shows a top view of the assembled reflective LED light tube assembly 210 shown in cross-sectional FIGS. 9 and 10, without the reflective half cylindrical light scattering longitudinal top cap 24, wherein the reflective heat dissipating LED PCBs 18 and 20 of FIGS. 4 and 5, powered from only one end, face each other and are longitudinally connected to a reflective half cylindrical light scattering longitudinal top cap 24 (not shown) with both reflective interior end caps 50 and 52 attached and the LED light is reflected upward using 45° LED sconce directional light deflectors 23. A first LED PCB 18 and second LED PCB 20 are both in electrical communication with a reflective interior power supply circuit end cap 50 with two electrical bi-pins 44. A thermoelectric cooling element 11 is shown on the back of both reflective heat dissipating LED PCBs 18 and 20. The thermoelectric cooling element 11 may also be an outside layer on the back of both reflective heat dissipating LED PCBs 18 and 20. At least one of the bi-pin end caps is in electrical communication with both reflective heat dissipating LED PCBs.

A thermoelectric cooler is a solid state device that produces a cold side on one side and a hot side on the opposite side when an electric voltage is applied to two joined dissimilar metals. A temperature differential is created where the heat is transferred from one metal surface to the other joined metal surface, based on the polarity of the electric current. Reversing the polarity reverses the direction of heat transfer. Placing a thermoelectric cooler on the bottom of each LED would also have added benefits. An LED with a thermoelectric cooler on the bottom (opposite of the phosphor side) would be able to operate with more current without degrading or burning out the LED phosphor or electrical junctions.

FIGS. 18-20 all show two alternating rows of LEDs 12 to double the luminosity of the printed circuit board 10 and the reflective LED light tube assembly.

FIG. 18 shows a top view of two alternating rows of LEDs 12 mounted on a light reflective heat dissipating printed circuit board 10.

FIG. 19 shows a top view of two alternating rows of LEDs 12 mounted on a light reflective heat dissipating printed circuit board 10 shown in FIG. 22, where each row of LEDs 12 has bottom mounted horizontal light deflectors 56 and 58 located on the bottom of each LED 12.

FIG. 20 shows a top view of two alternating rows of LEDs 12 mounted on a light reflective heat dissipating printed circuit board 10 shown in FIG. 23, where each LED 12 is covered with LED sconce directional light deflectors 23 directing the light into the reflective double half cylindrical light scattering longitudinal top cap 70

FIG. 21 shows a cross-sectional view of the assembled reflective LED light tube assembly 300 wherein two LED PCBs 18 and 20 of FIG. 18 face each other and are longitudinally connected to a reflective half cylindrical light scattering longitudinal top cap 24 and a longitudinal light transmissible planar lens cap 30, and the side viewing angles of the top side view 26*d* of LEDs 12 and bottom side view 12*d* rows of LEDs 12 is shown.

FIG. 22 shows a cross-sectional view of the assembled reflective LED light tube assembly 300 wherein two LED PCBs 18 and 20 of FIG. 19 face each other and are longitudinally connected to a reflective half cylindrical light scattering longitudinal top cap 24 and a longitudinal light transmissible Fresnel planar lens cap 36 where a top row of LEDs 12 has bottom mounted horizontal light deflectors 56 and a bottom row of LEDs 12 has bottom mounted horizontal light deflectors 58. This embodiment is not desirable because the bottom mounted horizontal light deflector 58 would block too much light exiting the reflective LED light tube assembly 300, but it is being shown as one possible embodiment. Using photovoltaic panels on the inside reflective surfaces of the LED PCBs 10 would be the only use of this embodiment.

FIG. 23 shows a cross-sectional view of an assembled reflective LED light tube assembly 400 wherein two LED PCBs 18 and 20 of FIG. 20 face each other and are longitudinally connected to a reflective double half cylindrical light scattering longitudinal top cap 70 and a longitudinal light transmissible half cylindrical Fresnel lens cap 60, where each LED 12 is covered with LED sconce directional light deflectors 23 directing the light into the reflective double half cylindrical light scattering longitudinal top cap 70. Using a longitudinal light transmissible half cylindrical Fresnel lens cap 60 would be the preferred embodiment because of the greater amount of light dispersion, and the reduction in weight and material required to produce a longitudinal light transmissible half cylindrical Fresnel lens cap 60. It would be obvious to one skilled in the art to increase or decrease the amount of curved lenses based on the application where the reflective LED light tube assembly is used. An exploded view of the second side reflective LED light tube heat dissipating PCB 20 includes a thermoelectric cooling layer 11 (copper), a heat dissipating layer 9 (aluminum), a printed circuit with LEDS on a dielectric layer 13, and an interior light deflecting layer 21.

FIG. 24 shows a cross-sectional view of the assembled reflective LED light tube assembly 500 wherein two LED PCBs 64 and 66 face each other and are longitudinally connected to a reflective double half cylindrical light scattering portion 72 of the interiorly reflective longitudinally m-shaped parallel side walled light scattering chassis 68 and a longitudinal light transmissible half cylindrical Fresnel lens cap 60, where each LED 12 is covered with LED sconce directional light deflectors 23 directing the light into the reflective double half cylindrical light scattering portion 72. Using a commercially available high brightness white LEDs, with a 120° light dispersal angle, in the reflective LED light tube assembly would be the only time the longitudinal light transmissible half cylindrical lens cap 40 or the longitudinal light transmissible planar lens cap 30 would be acceptable because the longitudinal light transmissible half cylindrical lens cap 40 and the longitudinal light transmissible planar lens cap 30 do not aid in distributing any light other than downward.

The reflective LED light tube assembly may be powered by AC electricity using the fluorescent light fixture's AC ballast, a full wave rectifier circuit (solid state diode, the vacuum tube diode, mercury arc valve, etc.), a pulse width modulation circuit, or a current limiting circuit. The reflective LED light tube assembly may be powered from the pre-existing fluorescent light fixture's AC ballast, wherein the two wire AC electricity is converted to DC electricity (AC input to DC output) for powering the reflective LED light tube assembly, the fluorescent light fixture's AC ballast can be replaced with a AC/DC transformer for powering the reflective LED light tube assembly, or the reflective LED light tube assembly may be powered by replacing the fluorescent light fixture's starter with a DC power supply, or by any known powering means known in the art. The reflective LED light tube assembly may also be powered from a electrolytic or preferably a ceramic capacitor, a capacitor in parallel or in series with a resistor, or a capacitor and inductor combination, fed with DC power, for providing a continuous and unvarying DC power source for the reflective LED light tube assembly. The means of powering the reflective LED light tube assembly is not as important as the scattered light produced by the reflective LED light tube assembly is not harsh on the eyes and the lumen output of the LEDs is not reduced by some type of opaque filter, covering or lens. There are types of filters and coverings which can be used to redirect the lumen output.

FIG. 25 shows a schematic for an electrical circuit (power supply circuit 14) to power two LED PCBs 18 and 20 using 110 v AC at 60 Hz. The first side reflective LED light tube reflective heat dissipating LED PCB 18 is powered by the positive AC sine wave and the second side reflective LED light tube reflective heat dissipating LED PCB 20 is powered by the negative AC sine wave, or vice versa. A dimming circuit is not shown.

The exact values for the, used or unused, electrolytic or preferably ceramic capacitor (C1) and the resistor (R1) are not provided because these two variables will slightly change based on the type of LEDs used, the amount of LEDs, the arrangement of the LED arrays (series or parallel), and the voltage or frequency of the electricity. A tested prior art circuit method for FIG. 25 includes: a 0.47 uF non-polarized electrolytic or ceramic capacitor (C1), with a voltage rating of 200 volts or more and an impedance of 5600 Ohms at 60 Hz, where the LED current is about 20 mA half wave or 10 mA average, and where a larger electrolytic or ceramic capacitor increases the current and a smaller one reduces the current; and a 1K ½ W resistor (R1) limits the surge of AC current into the circuit to around 150 mA, and drops to less than 30 mA in a millisecond as the electrolytic or ceramic capacitor charges.

The shown standard 110 v-120 v AC at 60 Hz power source used to power the present invention, may also include 220-230 v AC at 50 Hz power source. Obviously, at the higher 220-230 v AC voltages and 50 Hz frequencies the power supply circuit 14 schematic would have to be modified. This is the reason why the values for the non-polarized electrolytic or ceramic capacitor (C1) and the resistor (R1) are not shown.

A single LED is a low-voltage solid state device which cannot be directly powered using standard AC current without some circuitry to control the voltage applied and the current flow through the LED lamp. A series diode and resistor could be used to control the voltage polarity and limit the current flowing through the LED lamps, but this is inefficient because most of the applied voltage would be lost by producing heat in the resistor. A single series string of LEDs would minimize voltage losses, but when one LED fails in the series string of LEDs, the entire string will no longer work. Two or more series strings of LEDs are usually used to prevent total loss of the series strings of LEDs when one LED fails. Paralleled strings of LEDs increase the reliability of the parallel string of LEDs by providing redundancy when one LED fails. Because of the narrow angle of illumination and limited amounts of lumens produced by many LEDs, a number of LEDs must be placed close together in a lamp, bulb or fixture to combine all of the LEDs radiated illumination. When using multiple colored LEDs to produce a healthy and more natural light output, a uniform color distribution can be difficult to achieve because of the narrow angle of illumination the LEDs produce. Different color LEDs degrade in their illumination output over the course of the lifecycle of each individual colored LED, which can lead to uneven spectrum illumination. Prior art LED lamps consist of clusters of LEDs in a housing with LED driver circuitry, a heat sink and some type of optics.

In the present invention, the plurality of LEDs 12 are preferably in parallel electrical communication with the heat dissipating printed circuit board 10. The preferred embodiments use strings of parallel LEDs 12, opposed to the series string of LEDs 12, to maintain illumination if one of the LEDs 12 stops working.

Anyone skilled in the art knows that a LED can be powered from an 220+V 50 Hz or 110+V 60 Hz AC power source, but the lower voltage 110V 60 Hz AC power source is preferred. When a light emitting diode is powered by an alternating current power source, half of the time the LED is powered for illumination and the other half of the time the LED is unpowered. This means that each LED turns on and off 60 times per second. This would mean that a 50,000 hour rated LED, which was tested using a continuous DC power source, could theoretically function as a 100,000 hour LED, because the LED is not continually powered by a continuous DC power source.

LEDs are unaffected by cycling on and off. Any LED will only be lit when the AC current flows is in the proper direction. When the AC current flow reverses, the LED blocks current flow and remains unlit. This will cause the LED to blink on and off 60 times a second, even though it will appear to be continuously lit. This trick of the eye is a phenomenon known as "persistence of vision". Movie theaters and video recorders run at 24 or 30 frames a second and are seen by the eye using the phenomenon called "persistence of vision", in which an afterimage is thought to exist for approximately one twenty-fifth of a second on the retina.

FIG. 26 shows a cross-sectional view of the perpendicular light dispersal of the LED's 12 emitted perpendicular light of the FIG. 23 assembled reflective LED light tube assembly 400 wherein two LED PCBs 18 and 20 of FIG. 20 face each other and are longitudinally connected to a reflective double half cylindrical light scattering longitudinal top cap 70 and a longitudinal light transmissible half cylindrical Fresnel lens cap 60 (not labeled), where each LED 12 is covered with LED sconce directional light deflectors 23 directing the light into the reflective double half cylindrical light scattering longitudinal top cap 70.

FIG. 27 shows a cross-sectional view of the light dispersion of the FIG. 24 assembled reflective LED light tube assembly 500 wherein two LED PCBs 64 and 66 face each other and are longitudinally connected to a reflective double half cylindrical light scattering portion 72 of the interiorly reflective longitudinally m-shaped parallel side walled light scattering chassis 68 and a longitudinal light transmissible half cylindrical Fresnel lens cap 60, where each LED 12 is covered with LED sconce directional light deflectors 23 directing the light into the reflective double half cylindrical light scattering portion 72. The disassembled layers of the LED PCB 64 are shown wherein:

a printed circuit board with heat dissipating properties 10 has LEDs 12 mounted thereon, a thermoelectric cooling layer 11 is attached to the outer surface of the printed circuit board with heat dissipating properties 10 and a dielectric layer 13 separates the inner surface of the printed circuit board with heat dissipating properties 10 from the interiorly reflective longitudinally m-shaped parallel side walled light scattering chassis 68.

The preferred embodiment of the reflective LED light tube assembly uses the combination of elements found in:

the cross-sectional view shown in FIG. 23 wherein the assembled reflective LED light tube assembly 400 wherein two LED PCBs 18 and 20 of FIG. 20 face each other and are longitudinally connected to a reflective double half cylindrical light scattering longitudinal top cap 70 and a longitudinal light transmissible half cylindrical Fresnel lens cap 60, where each LED 12 is covered with LED sconce directional light deflectors 23 directing the light into the reflective double half cylindrical light scattering longitudinal top cap 70; or the cross-sectional view shown in FIG. 24 wherein the assembled reflective LED light tube assembly 500 wherein two LED PCBs 64 and 66 face each other and are longitudinally connected to a reflective double half cylindrical light scattering portion 72 of the interiorly reflective longitudinally m-shaped parallel side walled light scattering chassis 68 and a longitudinal light transmissible half cylindrical Fresnel lens cap 60, where each LED 12 is covered with LED sconce directional light deflectors 23 directing the light into the reflective double half cylindrical light scattering portion 72;

the top view shown in FIG. 17 wherein the reflective heat dissipating LED PCBs 18 and 20 are powered from only one end, face each other and are longitudinally connected to a reflective half cylindrical light scattering longitudinal top cap 24 (not shown), with both reflective interior end caps 50 and 52 attached and the LED light is reflected upward using 45° LED sconce directional light deflectors 23, a first LED PCB 18 and second LED PCB 20 are both in electrical communication with a reflective interior power supply circuit end cap 50 with two electrical bi-pins 44, a thermoelectric cooling element 11 on the back of both reflective heat dissipating LED PCBs 18 and 20 cools the printed circuit boards, a thermoelectric cooling element 11 is on an outside layer on the back of both reflective heat dissipating LED PCBs 18 and 20, and one of the bi-pin end caps is in electrical communication with both reflective heat dissipating LED PCBs 18 and 20, and the preferred embodiment's is powered using the power supply circuit 14 schematic shown in FIG. 25 to power two LED PCBs 18 and 20 using 110 v AC at 60 Hz, wherein the first side reflective LED light tube reflective heat dissipating LED PCB 18 is powered by the positive AC sign wave and the second side reflective LED light tube reflective heat dissipating LED PCB 20 is powered by the negative AC sign way, or vice versa. The recommended standard 110 v-120 v AC at 60 Hz power source found in the US, Canada, etc., used to power the present invention, may also include the European, Australian, etc. 220-230 v AC at 50 Hz power source. Obviously, at the higher 220-230 v AC at 50 Hz voltages, the power supply circuit 14 schematic shown in FIG. 25 would have to be modified.

The LED directional light deflector 22 or LED sconce directional light deflector 23 may be constructed from metal and the reflective surface may be polished to near a 100% reflective finish. The LED directional light deflector 22 or LED sconce directional light deflector 23 may be made out of a type of dielectric plastic and the reflective surface may be coated with a reflective material such as aluminum, silver, or some other reflective material.

The two preferred embodiments for manufacturing and mass-producing the side layers of the reflective LED light tube assembly include:

a first embodiment wherein the reflective heat dissipating LED PCBs 18 and 20 layers includes: 1) a thermoelectric cooling element 14 or layer 11 attached to the back of; 2) a heat dissipating LED PCB 10; and 3) a type of plastic or material layer (polished metal layer) with internal reflective surfaces (a dielectric spacer is used, if needed);

a second embodiment wherein the reflective heat dissipating LED PCBs 18 and 20 layers includes: 1) a thermoelectric cooling element 14 or layer 11 attached to the back of; 2) a heat dissipating LED PCB 10; with a 3) a dielectric material spacer 13 with thermal conductivity; externally attached to 4) a highly polished reflective side wall of an m-shaped metal chassis 68. The thermoelectric cooling element is not required in any preferred embodiment, but it increases efficiencies. A good dielectric material spacer 13 with thermal conductivity is the Bergquist S-Class Gap Pad® 5000S35, which has low thermal resistance and high thermal conductivity (5.0 W/m-K).

When an LED 12 is attached to a PCB, the LED 12 extends perpendicularly upwards are outwards from the PCB around 1/16 of an inch or more, making the assembly of the two preferred embodiments fast and easy. Although the present invention has been shown to use rectangular LEDs 12 vertically and horizontally aligned, the LEDs 12 can be attached to the PCBs at 45° angles, increasing the efficiencies of the LED sconce directional light deflectors 23 and reducing the LED sconce directional light deflector's 23 size. The LED sconce directional light deflectors 23 has been shown having only two reflective surfaces, but they can have three or more reflective surfaces by changing their geometry. It is also possible to use other sconce geometries with different light scattering features and different angles of reflection in the LED sconce directional light deflectors 23. Placing some type of lens over the top of the sconce will also produce different angles of refraction of the light emitted from the LEDs 12.

Another preferred embodiment (not shown) would require an LED manufacturer to produce a 120° light distribution LED module, where the phosphor is angled at 60° from the bottom of mounting surface and preferably has a thermoelectric cooling element on the bottom mounting surface. This LED configuration would allow the 60° angled LED to be mounted on the heat dissipating PCB where the light is directed into the reflective top portion and the LED directional light deflectors would not be required. This will also increase the light output of the reflective LED light tube assembly. The preferable tombstone shaped LEDs could also be bottom edge mounted on the PCBs at angles around 90°, aiming light directly into the reflective top portion or a bright white reflective interior surface top portion to reduce bright spots, but this type of LED embodiment is not available yet, manufactured, or prototyped. Aiming any LED or any type of light source directly into the reflective top portion or a bright white reflective interior surface top portion is also a preferred embodiment of the invention.

In some of the preferred embodiments, all of the structural elements (directional light deflectors, reflective sidewalls, and top domed reflectors) are preferably a reflectively coated polycarbonate or some other type of injectable resin, that are reflectively coated using any of the known in the art vacuum metalization processes and techniques (sputtering, cathodic arc deposition, thermal evaporation, etc.). The preferred metalization process uses aluminum with a hexamethayldisiloxane (HMDSO) top coat. The reason for the top coat of HMDSO over the aluminum, is to prevent the aluminum coating from oxidating. When using the aluminum sputtering deposition technique, aluminum is 92% reflective and has the highest reflective percentage, whereas; stainless steel is 60% reflective, nickel is 62% reflective, chrome is 65% reflective, and titanium is 50% reflective. A thin coating of silver over the aluminum would increase reflectivity.

The dimensions of the preferred embodiments shown in FIGS. 1-27 are only for illustrative purposes, and by changing the dimensions of the preferred embodiments a greater lumen output and light dispersion angle can be obtained. Increasing the distance between the two parallel LED PCBs allows more of the reflected light to leave the bottom of the reflective LED light tube assembly and allows greater dispersion of the light. Slanting the two parallel LED PCBs inwards or outwards may also be desirable in certain applications. One example would be where the two longitudinally non-parallel LED PCBs did not reflect the LED light output into the top reflective cap, shown in FIGS. 6-7, and the light generated by the LEDs exits the reflective LED light tube assembly through some type of light disbursing bottom lens, such as a Fresnel type lens or other known in the art light disbursing lens or means.

These and other features of the present invention will be more fully understood by referencing the drawings.

ADVANTAGES OF THE PRESENT INVENTION

The present invention, in one preferred embodiment, is configured to replace a conventional fluorescent light tube by inserting a reflective LED light tube assembly into both fluorescent light fixture's female fluorescent light socket ends, known in the art as tombstone connectors. Retrofitting fluorescent light fixtures with the preferred embodiment of the present invention, the "reflective LED light tube assembly", requires the steps of: 1) disconnecting the two wire AC power from the ballast; 2) removing the ballast for recycling; 3) attaching the two wire AC power source to one of the tombstones; 4) placing a sticker, or writing a plus sign (+) or (AC) on the electrified tombstone with a permanent marker; and 5) inserting the reflective LED light tube assembly into the fluorescent light fixture. An added feature would be to replace the on/off switch with a dimmer switch, or a dimmer switch with the capability of increasing the 110V to a greater voltage, or some type of smart on/off dimmer switch.

In summary, the present invention, previously described, has provided a reflective LED light tube assembly for dispersing the intense directional illumination of the LEDs reflectively positioned inside the light tube assembly and producing uniform linear light distribution, and more specifically, a reflective LED light tube assembly that can replace a fluorescent light bulb in a fluorescent light fixture. While the present invention disclosed has been described with reference to the preferred embodiments thereof, a latitude of modification, change, relocation of elements, repositioning of elements and substitution is intended in the foregoing disclosure, and in some instances, some features of the invention will be employed without a corresponding use of the inventions other features. Accordingly, it will be appreciated by those having an ordinary skill in the art that various modifications can be made to the system of the invention and it is appropriate that the description and appended claims are construed broadly and in a manner consistent with the spirit and scope of the invention herein, without departing from the spirit and scope of the invention as a whole. The invention is intended to cover various modifications and equivalent arrangements included within the scope of the appended claims, which scope is to be accorded the broadest interpretation so as to encompass all such modifications and equivalent structures as is permitted under the law.

The invention claimed is:

1. A reflective light emitting diode light tube assembly comprising:

a first plurality of light emitting diodes in electrical communication with a first printed circuit board;

a second plurality of light emitting diodes in electrical communication with a second printed circuit board;

said first and second printed circuit boards are longitudinally parallel and said first and second plurality of light emitting diodes facing each other;

the top edges of said first and second printed circuit boards are longitudinally connected to a longitudinal internally reflective top portion;

the bottom edges of said first and second printed circuit boards are longitudinally connected to a longitudinal bottom Fresnel lens portion, forming a reflective light tube assembly;

a first internally reflective end cap with an electrical communication connector is connected to a first end of said reflective light tube assembly and is in electrical communication with at least one of said first and second printed circuit boards; and a second internally reflective end cap with an electrical communication connector is connected to a second end of said reflective light tube assembly and is in electrical communication with at least one of said first and second printed circuit boards.

2. The reflective light emitting diode light tube assembly of claim 1, wherein said first and second printed circuit board's internal surface is reflective.

3. The reflective light emitting diode light tube assembly of claim 1, wherein said first and second printed circuit board's internal surface is covered with a reflective layer of material.

4. The reflective light emitting diode light tube assembly of claim 1, wherein said plurality of light emitting diodes on said first printed circuit board are powered by a positive alternating current sine wave, and said plurality of light emitting diodes on said second printed circuit board are powered by a negative alternating current sine wave; or vice versa.

5. The reflective light emitting diode light tube assembly of claim 1, wherein said plurality of light emitting diodes on said first and said second printed circuit board are in parallel electrical communication.

6. The reflective light emitting diode light tube assembly of claim 1, wherein said first and second printed circuit board's internal surface is covered with photovoltaic cells.

7. The reflective light emitting diode light tube assembly of claim 1, wherein said first and second printed circuit board's external surface is covered with thermoelectric cooler.

8. The reflective light emitting diode light tube assembly of claim 1, wherein a power supply circuit is disposed on the back of at least one of said first or said second printed circuit boards.

9. The reflective light emitting diode light tube assembly of claim 1, wherein a power supply circuit is disposed inside at least one of said first or said second internally reflective end caps.

10. The reflective light emitting diode light tube assembly of claim 1, wherein said longitudinal internally reflective top portion comprises a substantially half cylindrical structure.

11. The reflective light emitting diode light tube assembly of claim 1, wherein said longitudinal internally reflective top portion comprises two joined substantially half cylindrical structures, forming an m-shape.

12. The reflective light emitting diode light tube assembly of claim 1, wherein said longitudinal bottom lens portion is transparent.

13. The reflective light emitting diode light tube assembly of claim 1, wherein a directional light deflector is disposed over each light emitting diode of said plurality of light emitting diodes, reflecting the light emitting diode's light into said longitudinal internally reflective top portion.

14. The reflective light emitting diode light tube assembly of claim 1, wherein a light deflector is disposed beneath each light emitting diode of said plurality of light emitting diodes, preventing the light emitting diode's light from being seen directly from any angle beneath the reflective light emitting diodes light tube assembly.

15. The reflective light emitting diode light tube assembly of claim 1, wherein said plurality of light emitting diodes comprises at least two alternating rows of light emitting diodes.

16. The reflective light emitting diode light tube assembly of claim 1, wherein said electrical communication connector comprises an electrical male bi-pin type connector.

17. The reflective light emitting diode light tube assembly of claim 1, wherein said reflective light emitting diode light tube assembly comprises the dimensions to fit in a fluorescent light fixture.

18. A reflective light emitting diode light tube assembly comprising:

a first plurality of light emitting diodes in electrical communication with a first printed circuit board;

a second plurality of light emitting diodes facing said first plurality of light emitting diodes in electrical communication with a second printed circuit board;

said first and second printed circuit boards are longitudinally parallel and said first and second plurality of light emitting diodes direct lumen output into a longitudinal internally reflective top portion;

the top edges of said first and second printed circuit boards are longitudinally connected to said longitudinal internally reflective top portion comprises two joined substantially half cylindrical structures, forming an m-shape;

the bottom edges of said first and second printed circuit boards are longitudinally connected to a longitudinal bottom lens portion, forming a reflective light tube assembly;

a first internally reflective end cap with an electrical communication connector is connected to a first end of said reflective light tube assembly and is in electrical communication with at least one of said first and second printed circuit boards; and a second internally reflective end cap with an electrical communication connector is connected to a second end of said reflective light tube assembly and is in electrical communication with at least one of said first and second printed circuit boards.

19. A reflective light emitting diode light tube assembly comprising:

a first plurality of light emitting diodes in electrical communication with a first printed circuit board;

a second plurality of light emitting diodes in electrical communication with a second printed circuit board;

a longitudinal internally reflective structure comprising two joined substantially half cylindrical structures, forming an m-shape, wherein the outer edges of said two joined substantially half cylindrical structure also comprises two longitudinal parallel walls for externally joining said first and said second printed circuit boards, wherein said first and second printed circuit boards are longitudinally parallel and said first and second plurality of light emitting diodes facing each other, and the bottom edges of said first and second printed circuit boards and said two longitudinal parallel walls are longitudinally connected to a longitudinal bottom lens portion, forming a reflective light tube assembly;

a first internally reflective end cap with an electrical communication connector is connected to a first end of said reflective light tube assembly and is in electrical communication with at least one of said first and second printed circuit boards; and a second internally reflective end cap with an electrical communication connector is connected to a second end of said reflective light tube assembly and is in electrical communication with at least one of said first and second printed circuit boards.

* * * * *